US005101330A

United States Patent [19]

Suzuki

[11] Patent Number: 5,101,330

[45] Date of Patent: Mar. 31, 1992

[54] ILLUMINATION DEVICE

[75] Inventor: Minoru Suzuki, Saitama, Japan

[73] Assignee: Dai-Ichi Seiko Co., Ltd., Kawaguchi, Japan

[21] Appl. No.: 737,488

[22] Filed: Jul. 30, 1991

Related U.S. Application Data

[62] Division of Ser. No. 216,429, Jul. 7, 1988, Pat. No. 5,038,259.

[30] Foreign Application Priority Data

| | | | |
|---|---|---|---|
| Jul. 9, 1987 | [JP] | Japan | 61-169728 |
| Sep. 29, 1987 | [JP] | Japan | 62-147482[U] |
| Sep. 29, 1987 | [JP] | Japan | 62-147483[U] |
| Oct. 7, 1987 | [JP] | Japan | 62-152808[U] |
| Nov. 30, 1987 | [JP] | Japan | 62-181121[U] |
| Dec. 28, 1987 | [JP] | Japan | 62-197346[U] |
| Jan. 26, 1988 | [JP] | Japan | 63-7692[U] |
| Jan. 29, 1988 | [JP] | Japan | 63-9712[U] |

[51] Int. Cl.[5] ..... F21M 3/14

[52] U.S. Cl. ..... 362/256; 362/260; 362/224; 362/307; 362/343; 362/355; 313/607; 313/635

[58] Field of Search ..... 362/224, 217, 221, 222, 362/260, 255, 256, 293, 223, 307, 351, 355, 343; 313/116, 117, 607, 635

[56] References Cited

U.S. PATENT DOCUMENTS

| | | | |
|---|---|---|---|
| 4,432,044 | 2/1984 | Lautzenheiser | 362/256 X |
| 4,803,399 | 2/1989 | Ogawa et al. | 313/635 X |
| 5,038,259 | 8/1991 | Katoh et al. | 362/256 |

FOREIGN PATENT DOCUMENTS 1137558 5/1989 Japan .

*Primary Examiner*—Stephen F. Husar

*Attorney, Agent, or Firm*—Cushman, Darby & Cushman

[57] ABSTRACT

An illumination device comprising a reflecting plate, a single or a plural number of linear light source(s) arranged over said reflecting plate and a diffusing plate arranged over said light source(s), a light quantity adjusting means being arranged on the surface of the linear light source on between said light source(s) and said diffusing plate, and said illumination device being so adapted as to uniformalize luminance distribution on the diffusing plate by selecting shape and size of light-transmitting portions of the light quantity adjusting means.

2 Claims, 8 Drawing Sheets

ILLUMINATION DEVICE

This is a division of application Ser. No. 216,429, filed July 7, 1988, now U.S. Pat. No. 5,038,259.

BACKGROUND OF THE INVENTION a) Field of the Invention

The present invention relates to an illumination device, and more specifically to an illumination device so adapted as to permit obtaining a surface light source having uniform luminance.

b) Description of the prior art

The conventional illumination devices comprise linear light source(s) 2 consisting of a single or plural fluorescent tubes, etc. arranged over a flat or curved reflecting plate 1 as shown in FIG. 1, and a diffusing plate 3 arranged on the side opposite to the linear light source 2.

Out of these illumination devices, the illumination device using a single linear light source provides such luminance distribution on the diffusing plate as shown in FIG. 2 on which luminance is the highest at the central area close to the light source 1 and luminance is gradually lowered toward the marginal portion, thereby making luminance non-uniform over the entire range of the diffusing plate 3. Especially when the light source 2 is brought closer to the diffusing plate 3 to design a this illumination device, luminance is especially enhanced at the area right over the light source 2, out of the areas of the diffusing plate 3, by the rays emitted upward from the light source 2 and attaining directly to the diffusing plate 3. For this reason, attempts have previously been made to obtain uniform luminance distribution on the diffusing plate by reducing the rays emitted upward from the light source.

As a conventional example accomplished by such an attempt, there is known the illumination device disclosed by Japanese Published Unexamined Utility Model Application No. 90106/61. In this example as shown in FIG. 3, a plural number of linear light-shielding portions 4 having a definite width are arranged discontinuously on the top (close to the diffusing plate) of a fluorescent tube used as the linear light source. In this conventional example, the rays emitted upward from the light source are partially shielded by the light shielding portions and the rays to attain to the central area of the diffusing plate located right over the linear light source are reduced, thereby lowering luminance at the central area. However, luminance is still high at the outer areas neighboring the central area and luminance distribution is as shown in FIG. 4, whereby luminance distribution is not so uniform on the diffusing plate.

As another example of the illumination devices of this type, there is also known the illumination device disclosed by Japanese Published Unexamined Patent Application No. 133008/55. In this illumination device, arranged between the diffusing plate and the light source is a light quantity adjusting plate 6 on which light-shielding portions 5 such as black spots are distributed at an adequate density as shown in FIG. 5 for the purpose of obtaining relatively uniform luminance distribution by reducing the rays to reach the area at which luminance would be otherwise high.

This conventional illumination device can provide rather uniform luminance distribution on the diffusing plate, but requires delicate adjustment of the space between the light source and the light quantity adjusting plate at the assembly stage of the illumination device and therefore poses a relatively difficult problem to maintain high precision for the space. Further, when the illumination device comprises a plural number of light sources, distribution, density, etc. of the light-shielding portions must be varied on the light quantity adjusting plate in accordance with variation of luminance on the tube surfaces of the light source, thereby posing a difficult adjusting problem.

SUMMARY OF THE INVENTION

A primary object of the present invention is to provide a thin illumination device having a simple composition and providing uniform luminance distribution on the diffusing plate, said illumination device comprising a reflecting plate, at least one linear light source arranged over the reflecting plate, a diffusing plate arranged on the side opposite to the linear light source with regard to said linear light source and a light quantity adjusting means arranged on the surface of the linear light source or between the linear light source and the diffusing plate.

The illumination device according to the present invention uses as the light quantity adjusting means a light quantity adjusting plate which covers at least the portion of the light source close to the diffusing plate, has light-transmitting portions and opaque portions arranged alternately, and is composed as a member integral with the reflecting plate.

The illumination device according to the present invention comprises, as a light quantity adjusting means, a light-shielding member having a high light-shielding function at the top area thereof and arranged on the top surface of the light source tube.

The illumination device according to the present invention comprises, as the light quantity adjusting means, a portion having low reflectance formed on a reflecting mirror at a location right under the light source or in the vicinity thereof in addition to the light-shielding portions formed on the top of the light source tube.

The illumination device according to the present invention comprises, as the light quantity adjusting means, a light-shielding member which is arranged on the top surface of the light source tube, continuous to connect both the ends of the light source tube, made of an electrically conductive material and serves also as the trigger coat for the light source tube.

The illumination device according to the present invention comprises, as the light quantity adjusting means, a member having low reflectance which is formed on the reflecting plate at a location right under the light source or in the vicinity thereof made of an electrically conductive material and serves also as the trigger coat for the light source tube.

The illumination device according to the present invention is equipped, as the light quantity adjusting means, with a light quantity adjusting member formed on the top surface of the light source tube and a means for positioning a fluorescent tube to locate said light quantity adjusting member close to the diffusing plate.

DETAILED DESCRIPTION OF THE PREFERRED EMBODIMENTS

Now, the preferred embodiments of the present invention will be described below with reference to the accompanying drawings.

Figure 1:
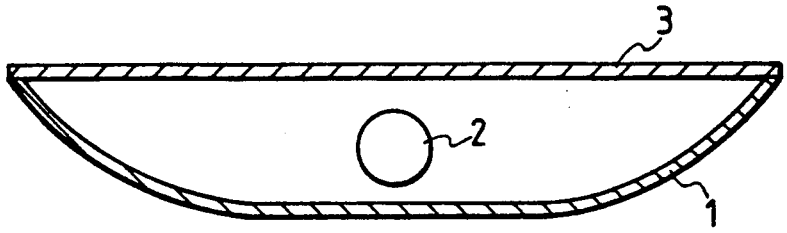
FIG. 1 PRIOR ART
FIG. 1 shows a sectional view illustrating the composition of the conventional illumination device.
Figure 2:
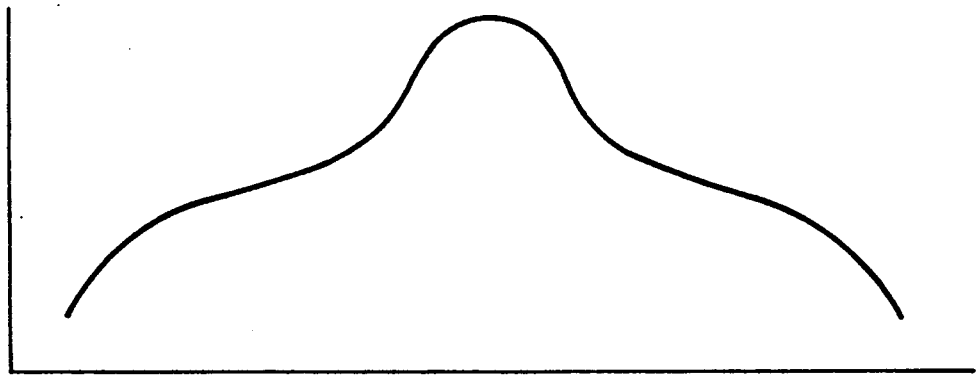
FIG. 2 PRIOR ART
FIG. 2 shows a graph illustrating luminance distribution obtained with the illumination device shown in FIG. 1.
Figure 3:
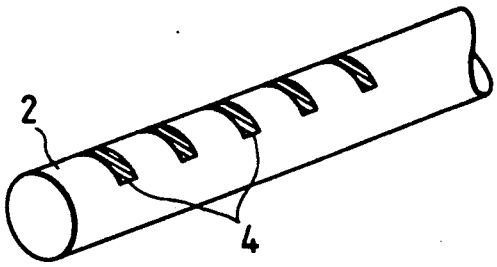
FIG. 3 PRIOR ART
FIG. 3 shows a perspective view illustrating the fluorescent tube used in the second example of the conventional illumination device.
Figure 4:
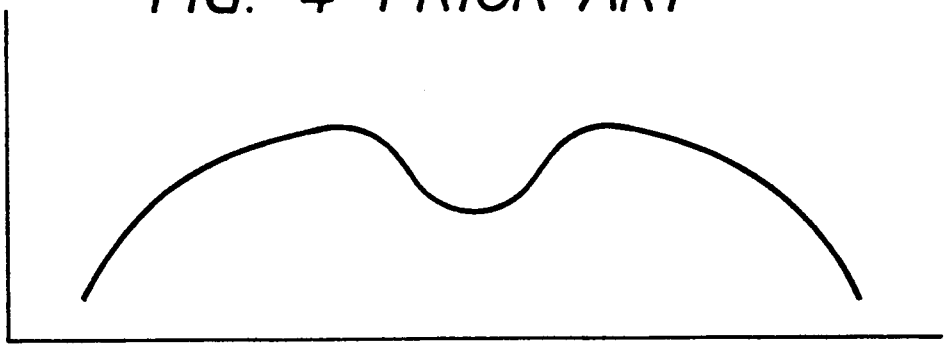
FIG. 4 PRIOR ART
FIG. 4 shows a graph illustrating luminance distribution obtained with the second example of the conventional illumination device.
Figure 5:
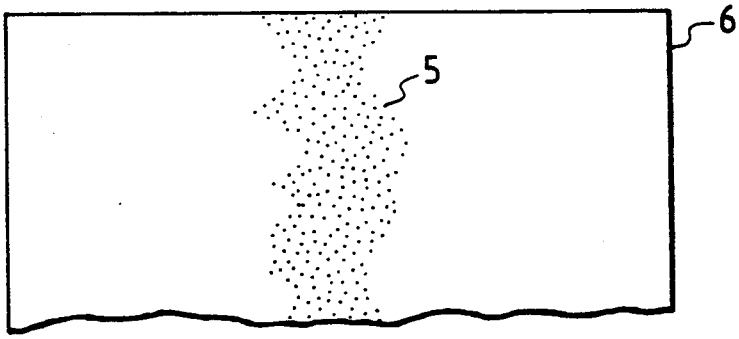
FIG. 5 PRIOR ART
FIG. 5 shows a plan view illustrating the light-shielding plate used in the third example of the conventional illumination device.
Figure 6:
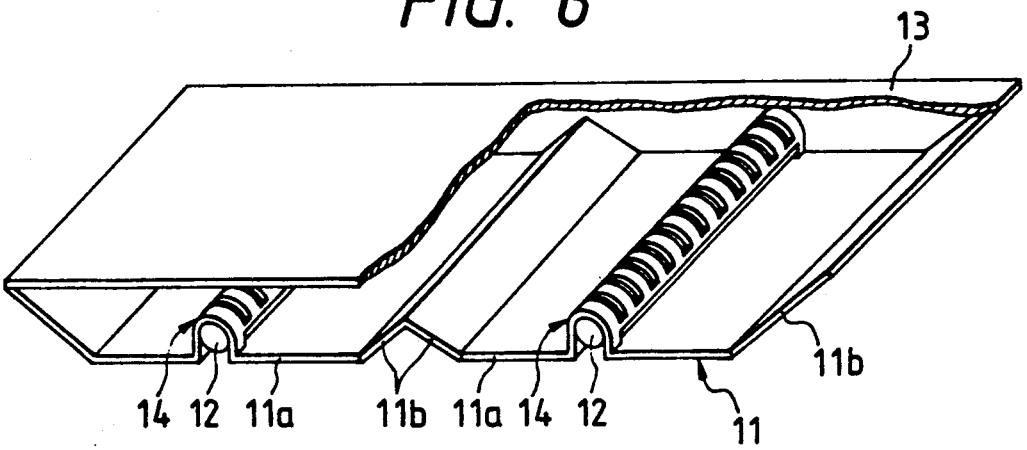
FIG. 6 shows a perspective view illustrating Embodiment 1 of the present invention.
Figure 7:
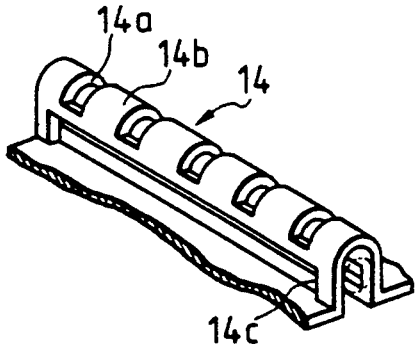
FIG. 7 shows a perspective view illustrating the light quantity adjusting member used in the Embodiment 1 of the present invention.

The Embodiment 1 of the present invention is illustrated in FIG. 6 showing a partially broken perspective view and FIG. 7 showing a perspective view of the light quantity adjusting member.

In these drawings, the reference numeral 11 represents a reflecting plate consisting of a flat bottom surface 11*a*, both ends and an intermediate inclined surface 11*b*, and having an inside mirror surface, the reference numeral 12 designates a linear light source located over the central portion of the bottom surface 11*a* of the reflecting plate 11, the reference numeral 13 denotes a diffusing plate arranged on the side opposite to the reflecting plate 11 with regard to the light source 12, and the reference numeral 14 represents a light quantity adjusting member arranged so as to surround the side of the light source 12 on the side of the diffusing plate 13 and formed integral with the reflecting plate.

The above-mentioned light quantity adjusting member 14 has, as shown in FIG. 7, a concavity having a sectional shape of arc in its inside so as to cover at least the portion of the light source 12 located on the side of the diffusing plate 13 (top side) and looks like a half of a cylinder in its appearance. Formed in the top surface (on the side of the diffusing plate 13) of the light quantity adjusting member are multiple apertures 14*a* having an optional shape and an optional size at optional intervals, and outside surface of the section 14*b* between each pair of the apertures 14*a* is designed as a reflecting surface. In other words, light-transmitting portions 14*a* and opaque (not transmitting light) portions 14*b* are formed alternately. Further, the light quantity adjusting member 14 is, as described above, made integral at the roots thereof with the reflecting plate 11. Width (area) of the light-transmitting portion and width (area) of the opaque portion 14*b* of the light quantity adjusting member 14 are adequately selected in accordance with brightness of the light source 12, space between the light source 12 and the diffusing plate 13, purpose of application and so on. Furthermore, formed in the sides of the light quantity adjusting member are rectangular apertures 14*c*.

Figure 8:
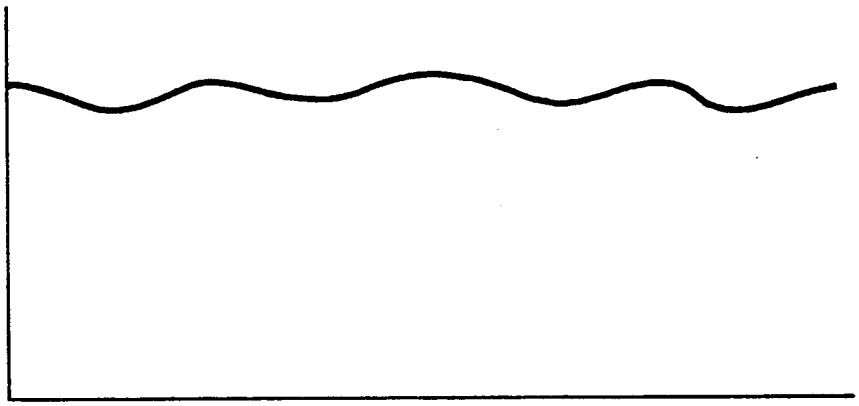
FIG. 8 shows a graph illustrating luminance distribution obtained with the Embodiment 1.

In the illumination device described as the Embodiment 1, the light emitted upward from the light source 12 is weakened by the light quantity adjusting member 14 and then reaches the diffusing plate 13. That is to say, the light emitted upward from the light source 12 partially passes through the apertures 14*a* and partially shielded by the opaque portions 14*b*. Since the light quantity is reduced as described above, luminance cannot be especially high at the areas of the diffusing plate 13 close to the light source even when the light source 12 is arranged near the diffusing plate 13. Further, the rays emitted sideways from the side of the light source are allowed to pass through the other aperture 14*c* formed in the light quantity adjusting member 14, and reach the intermediate area of the diffusing plate 13 located between the light source 12 and the inclined surface 11*b* of the reflecting mirror 11 or, after reflection on the inclined surface 11*b*, reach the end of the diffusing plate 13 or the intermediate area thereof between the light sources, whereby luminance distribution becomes substantially uniform as a whole on the diffusing plate 13 as shown in FIG. 8.

The reflecting plate 11 and the light quantity adjusting member 14 used in this embodiment can easily be manufactured by molding a synthetic resin as an integral member having the form shown in FIG. 6 and FIG. 7, and evaporation-coating the molding entirely with aluminium or the similar material at a single step. The illumination device described as the Embodiment 1 can easily be composed by arranging a linear light source 12 in the concavity formed inside the half-cylinder member consisting of the reflecting plate 11 integral with the light quantity adjusting member 14, and further attaching the diffusing plate 13.

Though the upper surface of the light quantity adjusting member is formed as a reflecting surface in the Embodiment 1 described above, the upper surface may be a black light-absorptive surface. In such a case, no influence is produced by the rays reflected by the top surface of the light quantity adjusting member and luminance is uniform on the diffusing plate 13 even when said plate is arranged very close to the light source, thereby making it possible to obtain a thinner illumination device.

In order to form the black light quantity adjusting member integral with the reflecting plate, it is sufficient to mold a black resin into the form of the whole member consisting of the light quantity adjusting member and the reflecting plate, and evaporation-coating the whole plate with aluminium of the similar material while masking the light quantity adjusting member having the half-cylinder form.

Further, a light quantity adjusting member having a white surface can be formed by molding a white resin into the form of the whole member consisting of the reflecting plate integral with the light quantity adjusting member and evaporation-coating the reflecting surface only of the reflecting plate in the manner similar to that described above. Since this light quantity adjusting member scatters light by the white top surface thereof, it can be used effectively in an illumination device in which a relatively wide space is reserved between the light source and the diffusing plate.

Moreover, it is possible to form the reflecting plate and the light quantity adjusting member as an integral member made of a transparent material. In this case, it is unnecessary to form the apertures 14*a* and 14*c* so long as the portions corresponding to the opaque portions 14*b* are reflecting surfaces, black surfaces or white surfaces, and a reflecting surface is formed on the area corresponding to the reflecting plate 11. Then, all the areas other than the opaque portions 14*b* of the half-cylinder member are made of the transparent material and function as light-transmitting members. The similar light quantity adjusting effect can be obtained also by designing the opaque portions 14*b* as translucent portions In addition, the object of the present invention can be accomplished by designing the top surface of the half-cylinder member entirely as a translucent surface.

Figure 9:
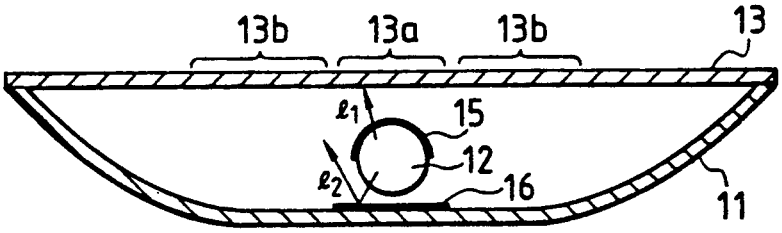
FIG. 9 shows a sectional view illustrating composition of Embodiment 2 of the present invention.
Figure 10:
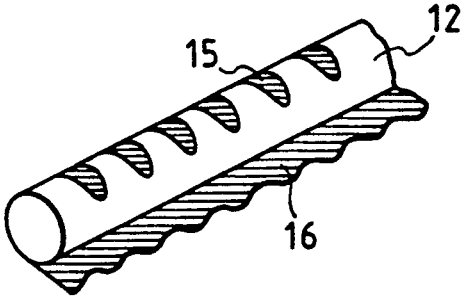
FIG. 10 shows a perspective view illustrating shapes of the light quantity adjusting member and low-reflectance portion used in the Embodiment 2.

Illustrated in FIG. 9 is Embodiment 2 of the illumination device according to the present invention in its sectional view wherein the reference numeral 11 represents a reflecting plate, the reference numeral 12 designates a linear light source and the reference numeral 13 denotes a diffusing plate: these members being substantially the same as those used in the Embodiment 1. The reference numeral 15 represents a light quantity adjusting member arranged on the top surface of a fluorescent tube 12 used as the linear light source and composed of a light-shielding film having discontinuous patterns, for example, as shown in FIG. 10. This light-shielding film is formed by applying a black material directly to the fluorescent tube or bonding a transparent sheet marked with black patterns to the fluorescent tube. The reference numeral 16 designates a low-reflectance member made of a light absorptive substance and arranged in the vicinity of the portion located right under the linear light source 12. The low-reflectance member has a shape, for example, as shown in FIG. 10.

In the Embodiment 2, light quantity is reduced since the rays emitted upward from the linear light source 12, like the ray $l_1$, are partially shielded by the light quantity adjusting member (the light shielding patterns). Further, the rays reflected in the vicinity of the portion right under the light source 12, like the ray $l_2$, are reflected by the low-reflectance member 16 and the light quantity is reduced. The rays emitted upward from the linear light source 12 and attaining to the central portion 13*a* of the diffusing plate 13 as well as the rays emitted downward from the linear light source 12, reflected obliquely upward and attaining to the central portion 13*b* neighboring the central portion 13*a* of the diffusing plate 13 are weakened as described above. Since the Embodiment 2 is capable of adjusting quantity of the rays attaining to the central portion 13*a* and neighboring portion 13*b* of the diffusing plate 13, the Embodiment 2 can further uniformalize luminance distribution on the diffusing plate 13.

In the Embodiment 2 illustrated in FIG. 9, the light-shielding patterns may be rectangles having a definite width and a definite length arranged discontinuously at definite intervals. In case of the discontinuous rectangular patterns, however, light quantity is abruptly varied between the top of the fluorescent tube having the light quantity adjusting member (the light-shielding patterns) 15 and the side of the fluorescent tube having no light quantity adjusting member. Accordingly, linear luminance non-uniformity stripes may be produced on the diffusing plate 13 in parallel to the linear light source 12. Therefore, the discontinuous patterns consisting of the oval light-shielding patterns as shown in FIG. 10 are more preferable.

The patterns on the light quantity adjusting member may be, in addition to those shown in FIG. 10, the patterns illustrated in FIG. 11 through FIG. 15.

Figure 11:
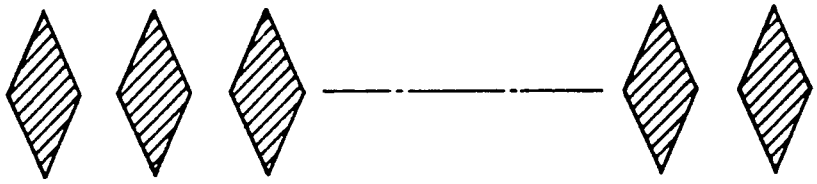
FIG. 11 through FIG. 15 show diagrams illustrating different forms of the light quantity adjusting member used in the Embodiment 2 of the present invention.

The patterns on the light quantity adjusting member shown in FIG. 11 are multiple rhombic light-shielding patterns arranged at definite intervals.

Figure 12:
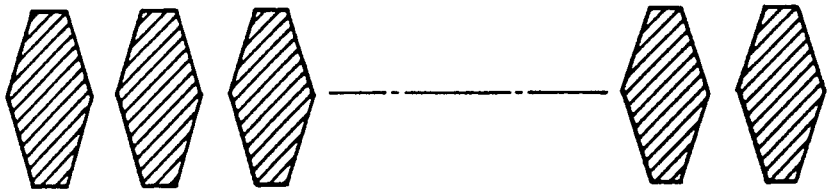

The patterns shown in FIG. 12 are multiple light-shielding patterns, each consisting of two trapezoids.

Each of the patterns shown in FIG. 11 and FIG. 12 has a larger width on the top of the fluorescent tube and a smaller width on the side of the fluorescent tube so that the light source equipped with the light-shielding patterns emits rays upward in the smallest quantity and light quantity gradually increases toward the side of the fluorescent tube.

Figure 13:
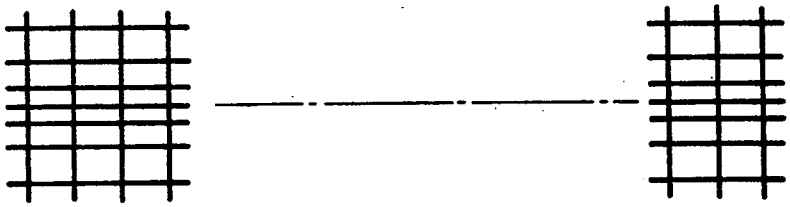

The light-shielding pattern shown in FIG. 13 is a lattice having horizontal stripes at the highest density on the top of the fluorescent tube and the density of the horizontal stripes is lowered toward the side of the fluorescent tube. Accordingly, the transparent (not shielding light) area is the narrowest on the top of the fluorescent tube and becomes larger toward the side of the fluorescent tube. As a result, light quantity is the smallest on the top of the fluorescent tube and becomes larger toward the side of the fluorescent tube.

Figure 14:
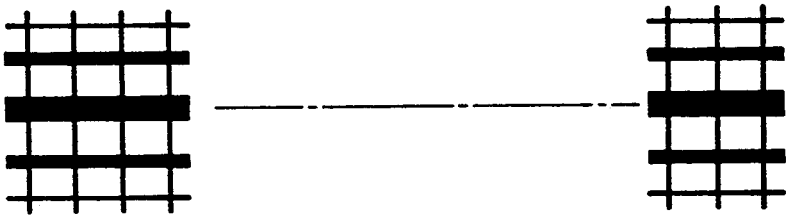

The light-shielding pattern shown in FIG. 14 is a lattice consisting of stripes having varying thickness. Speaking more specifically, the stripes are the thickest on the top of the fluorescent tube and become thinner toward the side of the fluorescent tube. Accordingly, the pattern shown in FIG. 14 provides substantially the same effect as that obtained with the pattern illustrated in FIG. 13.

Figure 15:
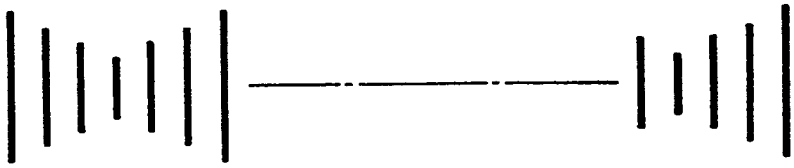

FIG. 15 shows light-shielding patterns consisting of lines having different lengths. Since light quantity is varied from location to location on the side of the fluorescent tube, it is possible to prevent the linear luminance non-uniformity stripes from being produced on the diffusing plate.

In addition to the light-shielding patterns described above, it is possible for accomplishing the object of the present invention to design the top surface of the fluorescent tube as a translucent surface functioning as the light adjusting member having transmittance gradually increasing from the top toward the side of the fluorescent tube. Further, it is also possible to design the light-shielding patterns shown in FIG. 10 through FIG. 15 so as to have varying transmittance. Moreover, the object of the present invention can be accomplished by forming multiple black spots at varying densities on the top of the fluorescent tube.

In the next place, the low-reflectance member formed on the reflecting plate 12 is not limited to that illustrated in FIG. 10. For example, the low-reflectance member may have a rectangular shape In case of the low-reflectance member having a rectangular shape, however, linear luminance non-uniformity stripes may be produced on the diffusing plate 13 due to the linear boundary between the reflecting plate 11 having high reflectance and the low-reflectance member 16.

Figure 16:
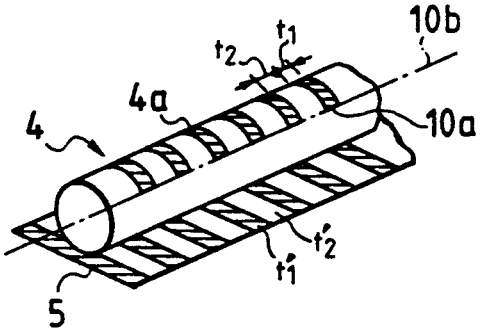
FIG. 16 and FIG. 17 show a perspective view and a plan view illustrating different forms of the low-reflectance portion.
Figure 17:
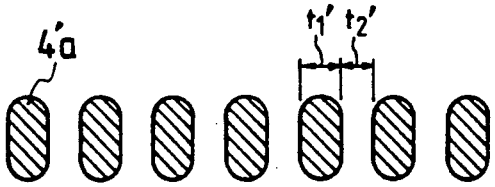

Different shapes of the low-reflectance member 16 are exemplified in FIG. 16 and FIG. 17.

The low-reflectance member shown in FIG. 16 consists of linear low-reflectance films having a definite width $t_1'$ and made, for example, of a light absorptive material arranged at definite intervals $t_2'$.

Further, the low-reflectance member shown in FIG. 17 consists of multiple oval films arranged at definite intervals.

Out of the light quantity adjusting members and low-reflectance members used in the Embodiments described above, the low-reflectance member consisting of discontinuous films permits selecting quantity of rays transmitting through the light quantity adjusting member or quantity of rays reflected by the low-reflectance member by selecting the width $t_1$ or $t_1'$ and interval $t_2$ or $t_2'$. It is therefore possible to obtain uniform luminance on the diffusing plate by properly selecting $t_1$, $t_2$, $t_1'$ and $t_2'$.

Figure 18:
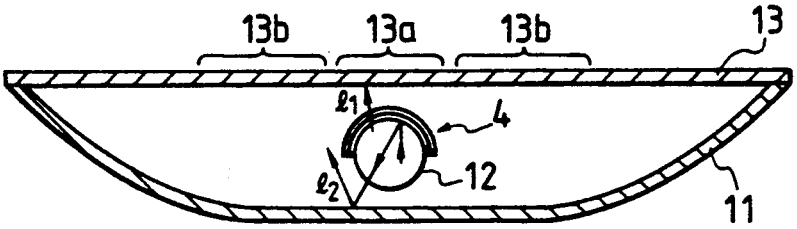
FIG. 18 shows a sectional view illustrating composition of Embodiment 3 of the present invention.
Figure 19:
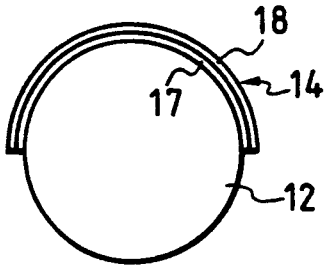
FIG. 19 shows a sectional view illustrating the fluorescent tube used in the Embodiment 3.

FIG. 18 illustrates a sectional view showing Embodiment 3 of the illumination device according to the present invention. In this embodiment, a light absorptive layer or low-reflectance layer 18 is formed as the light quantity adjusting member 14, with a reflecting layer 17 interposed, on the top surface of the fluorescent tube 12 used as the linear light source.

In the illumination device preferred as the Embodiment 3, the rays directed to portions where the light quantity adjusting member 14 does not exist, like the ray $l_1$ out of the rays emitted upward from the light source 12, attains directly to the diffusing plate 13. However, the rays directed to the portions where the light quantity adjusting member exists are reflected by the reflecting layer 17 located on the side of the light source, further reflected, like the ray $l_2$ by the reflecting plate and then directed to the diffusing plate 13.

Since the rays emitted upward from the light source 12 are partially cut by the light quantity adjusting member 14, similarly to the rays in the other embodiments, only the central portion of the diffusing plate 13 is not especially bright and luminance distribution is relatively uniform on the diffusing plate 13. Further, since the cut rays are reflected by the reflecting layer 17 and reaches, like the ray $l_2$, the marginal portion of the diffusing plate 13, the rays are utilized effectively with no loss.

If the light absorptive layer 18 is glossy in this embodiment, the rays reflected on the surface of said layer may attain especially to the central portion, etc. of the diffusing plate 13, thereby producing non-uniform luminance distribution. It is therefore desirable to design the light absorptive layer 18 so as to have a rough surface or not to be glossy.

A layer coated with a black paint can be considered as the light absorptive layer 18, but such a layer may allow the patterns marked on the light quantity adjusting member to be visible through the diffusing plate while the light source is not ignited. A white paint should be used in order to prevent this inconvenience. The surface of the light absorptive layer 18 should not be glossy also when it is coated with a white paint.

The light quantity adjusting member used in the Embodiment 3 can adopt any of the patterns used in the other embodiments shown in FIG. 10 through FIG. 15.

Figure 20:
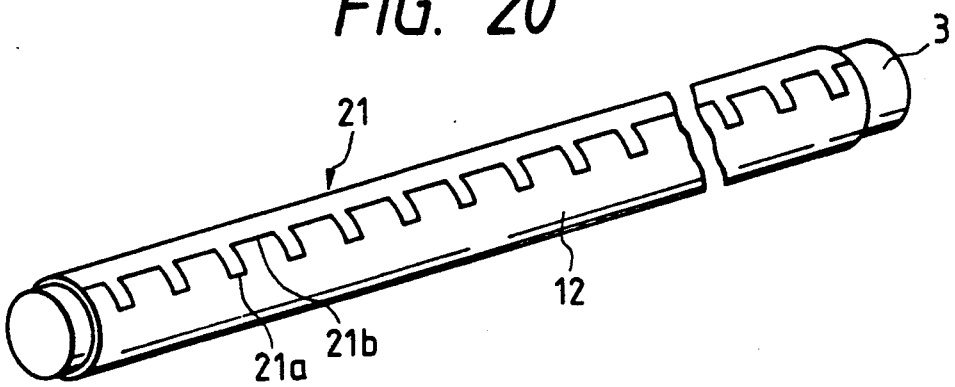
FIG. 20 shows a perspective view illustrating the fluorescent tube used in the illumination device preferred as Embodiment 4 of the present invention.

FIG. 20 shows a perspective view illustrating Embodiment 4 of the present invention. The Embodiment 4 is different from the other embodiments in the light quantity adjusting member formed on the fluorescent tube used as the linear light source, and is the same as the other embodiments in the other members. Accordingly, only the fluorescent tube is shown in FIG. 20. In this drawing, the reference numeral 21 represents the light quantity adjusting member which is made of an electrically conductive material, unlike the light quantity adjusting members used in the other embodiments, and has a shape continuous from the end 20 of the fluorescent tube 12 or the vicinity thereof to the other end 20 or the vicinity thereof. This light quantity adjusting member serves to obtain uniform luminance on the diffusing plate in the same manner as in the other embodiments and also functions as a trigger coat for the fluorescent tube.

Figure 21:
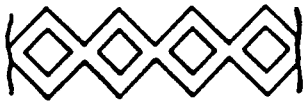
FIG. 21 through FIG. 23 show diagrams illustrating other examples of the pattern formed on the fluorescent tube in the Embodiment 4 of the present invention.
Figure 22:
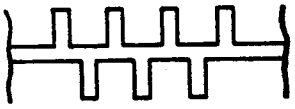
Figure 23:
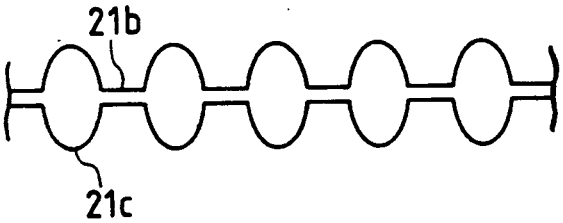

FIG. 21 through FIG. 23 show other patterns on the light quantity adjusting member used in the Embodiment 4. These patterns are also made of electrically conductive materials and continuous from the end to the other end of the fluorescent tube.

In addition to these patterns, the discontinuous patterns already described above can be used on the light quantity adjusting member also serving as the trigger coat when said patterns are made continuous. For composing the light quantity adjusting member made of an electrically conductive material so as to serve also as the trigger coat as in the Embodiment 4, it is sufficient to form the light quantity adjusting member on the fluorescent tube at a position in parallel to the center line of the tube. Accordingly, the Embodiment 4 facilitates positioning of the light quantity adjusting member as compared with the other embodiments which form the light quantity adjusting members on the fluorescent tubes having the trigger coats.

Further, it is possible to design the low-reflectance member 16 shown in FIG. 9, etc. so as to serve also as a trigger coat. That is to say, it is sufficient for this purpose to compose said low-reflectance member 16 of an electrically conductive material. When the low-reflectance member is made of an electrically conductive material as described above, it is unnecessary to form a trigger coat on the fluorescent tube since it is arranged close to the low-reflectance member. Printing ink containing carbon, aluminium, copper, etc. can be used as the materials to compose the low-reflectance member.

Also when the low-reflectance member is so designed as to serve as a trigger coat, positioning of the light quantity adjusting member is facilitated at the stage to form the light quantity adjusting member on the fluorescent tube.

Figure 24:
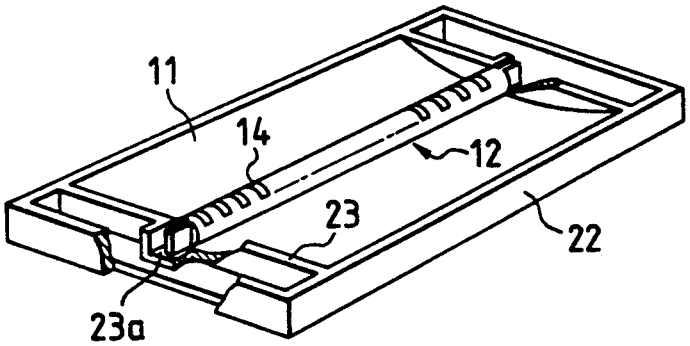
FIG. 24 shows a perspective view illustrating an illumination device preferred as Embodiment 5 of the present invention.

FIG. 24 shows a perspective view illustrating Embodiment 5 of the present invention.

Figure 25:
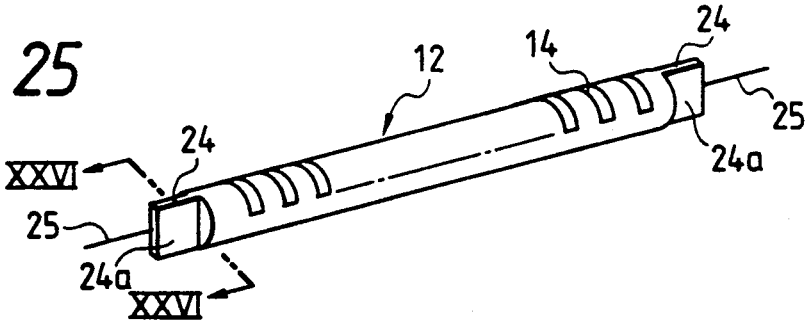
FIG. 25 shows a perspective view illustrating the fluorescent tube used in the Embodiment 5.
Figure 26:
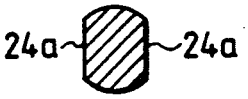
FIG. 26 and FIG. 27 show sectional views illustrating the ends of the fluorescent tube shown in FIG. 25.

Out of the illumination devices according to the present invention, the embodiments which form the light quantity adjusting member on the fluorescent tube require arranging the fluorescent tube so that the light quantity adjusting member correctly faces the diffusing plates at the stage of assembly. The Embodiment 5 facilitates the positioning of the fluorescent tube In FIG. 24, the reference numeral 22 represents the illumination device body and the reference numeral 23 designates a holding plate having a positioning portion 23*a*. The illumination device is composed of the reflecting plate 11 arranged in the body 22, the holding plate 23 for holding the fluorescent tube 12 equipped with the light quantity adjusting member 14 and a diffusing plate (not shown) arranged on the body. The fluorescent tube 12 has the composition shown in FIG. 25 and its end 24 is formed in the shape having flat surfaces 24*a*. The reference numeral 25 represents a lead wire.

Figure 27:
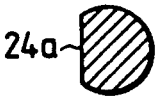
Figure 28:
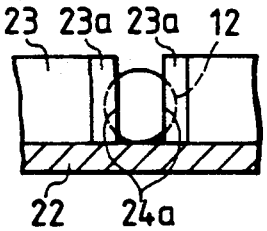
FIG. 28 shows a sectional view illustrating a positioning mechanism for the fluorescent tube shown in FIG. 25.

Since the flat surfaces 24*a* are formed at the ends 24 of the fluorescent tube 12, it can be held in the correctly positioned state simply by inserting and holding the ends 24 into the positioning portions 23*a* of the holding plate 23 as shown in FIG. 28. Further, the light quantity adjusting member 14 cannot be mispositioned due to rotation of the fluorescent tube after it is set in position. The flat surface may be formed only on one side at the end of the fluorescent tube as shown in FIG. 27.

FIG. 29 through FIG. 34 show other examples of the positioning means for the fluorescent tube, i.e., combinations of the positioning portion of the holding plate 23 and end of the fluorescent tube.

Figure 29:
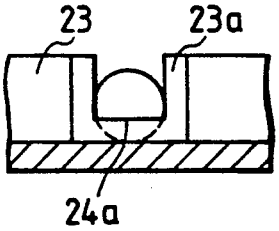
FIG. 29 through FIG. 32 shown sectional views illustrating other examples of the positioning mechanism.

In the example shown in FIG. 29, a flat surface is formed on the bottom at the end 24 of the fluorescent tube so as to correctly position the fluorescent tube by a combination with the positioning portion of the holding plate.

Figure 30:
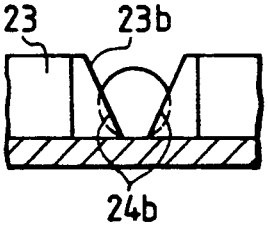

In the example shown in FIG. 30, the fluorescent tube has a V-shaped end 24*b* and a V-shaped groove 23*b* is formed in the positioning portion of the holding plate 23.

Figure 31:
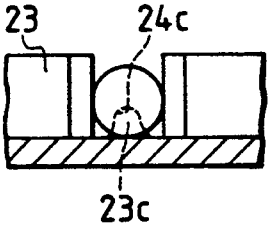

In the example shown in FIG. 31, a concavity 24*c* is formed in the end of the fluorescent tube so as to position the fluorescent tube by a combination with a protrusion 23*c* formed on the holding plate 23.

Figure 32:
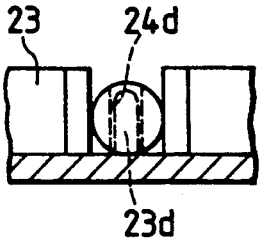

In the example illustrated in FIG. 32, the fluorescent tube is positioned by a combination of a hole 24*d* formed in the end of the fluorescent tube and a pin 23*d* studded in the holding plate 23.

Figure 33:
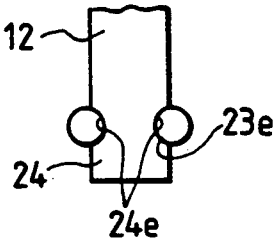
FIG. 33 and FIG. 34 show plan views illustrating different positioning mechanisms.

FIG. 33 shows an example wherein the fluorescent tube is positioned by concavities 23*e* formed on both the sides of the end of the fluorescent tube and two pins 24*e* studded in the holding plate 23.

Figure 34:
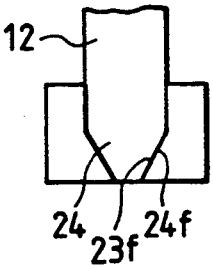

FIG. 34 illustrates an example so adapted as to position the fluorescent tube by a thinned tip 24*f* of the end of the fluorescent tube and the holding plate 23*f* having a support of the matching shape.

The diagrams shown in FIG. 33 and FIG. 34 are top views respectively.

The low-reflectance members arranged on the reflecting plate located right under the fluorescent tube used as the linear light source in the embodiments described above are formed by applying low-reflectance substances or bonding low-reflectance sheets to the predetermined position on the reflecting plate. The low-reflectance members must be precisely positioned so as to be located right under the fluorescent tube when the illumination device is assembled.

In order to meet this demand and form the low-reflectance member in simple procedures, the following means can be used.

Figure 35:
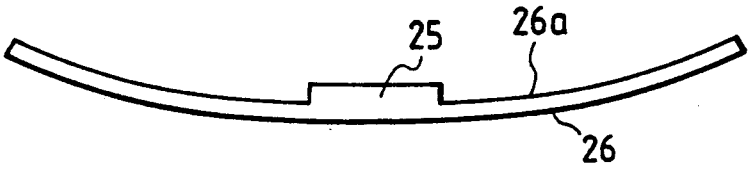
FIG. 35 and FIG. 36 show sectional views illustrating reflecting plates facilitating to form the low-reflectance portions on the reflecting plate.

At the stage to mold the reflecting plate with a synthetic resin, a reflecting plate body is prepared in the form, as shown in FIG. 35, having a convexity 25 at the position where the low-reflectance member is to be formed. Then, an aluminium layer is formed on the surface 26*a* of the reflecting plate body 26. Further, the convexity 25 is cut so as to cut off the aluminium layer from only the convexity 25 and expose the synthetic risin layer having low reflectance to be used as the low-reflectance member. By this method, the cut surface will be a rough surface as desired.

Figure 36:
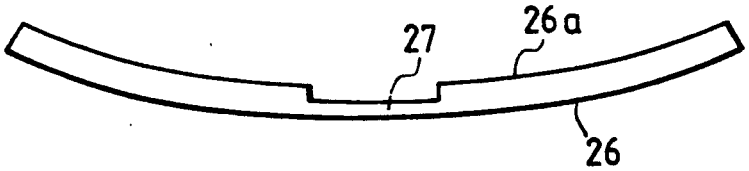

As another means, a reflecting plate body 26 is molded by a synthetic resin in the form, as shown in FIG. 36, having a concavity 27 at the position where the low-reflectance member is to be formed, a low-reflectance tape is bonded to the concavity 27 and a layer of aluminium or the similar material is formed on the other surface, whereby a low-reflectance member is formed.

A third means to form the low-reflectance member is as described below. A tape is bonded, by the hot stamp method or the similar method, to the position where the low-reflectance member is to be formed on the reflecting plate body and then a layer of aluminium or the similar material is formed on the surface of the reflecting plate body, whereafter the tape is peeled off to expose the base skin of the reflecting plate body at the position to be used as the low-reflecting member.

As a variant of the third means described above, a ribbon is formed by integrating a release tape with a metallic foil composing a metal layer and, at the stage to mold the reflecting plate body with a synthetic resin, a mirror surface including the ribbon is formed by the insert mold method. After the molding, a low-reflecting member is formed at the predetermined position by peeling off the tape.

A fourth means to form the low-reflectance member is to mark the boundary around the low-reflectance member at the stage to form a layer of metal such as aluminium on the reflecting plate, and bond a low-reflectance tape along the marks.

For marking the boundary, it is sufficient to use a mask at the stage to form the metal layer. Alternately, linear concavities or linear convexities may be formed as the mark at the stage to mold the reflecting plate body with a synthetic resin. When the reflecting plate is to be formed by bonding a metal foil ribbon to the surface of the reflecting plate body by the insert mold method or hot stamp method, it is sufficient to trace marks on the ribbon.

The present invention has been described in connection with what is presently considered to be the most practical and preferred embodiments. However, it is to be understood that the invention is not limited to the disclosed embodiments, but is intended to cover various modifications and equivalent arrangements included within the spirit and scope of the appended claims.

What is claimed is:

1. An illumination device comprising:

a reflecting plate, at least one linear light source arranged over said reflecting plate and having a light quantity adjusting member on the top thereof, and a diffusing plate arranged on the side opposite to said reflecting plate with regard to said light source, said light quantity adjusting member being discontinuously arranged light-shielding films in a shape having the largest width at the top of the light source and narrower width toward the side of the light source, wherein said light quantity adjusting member is a light shielding film made of an electrically conductive material having the largest light-shielding area at the top, having smaller light-shielding area toward the side and continuous from one end to the other end of the light source.

2. An illumination device comprising:

a reflecting plate, at least one linear light source arranged over said reflecting plate and having a light quantity adjusting member on the top thereof, and a diffusing plate arranged on the side opposite to said reflecting plate with regard to said light source, said light quantity adjusting member being discontinuously arranged light-shielding films in a shape having the largest width at the top of the light source and narrower width toward the side of the light source, wherein said reflecting plate has a low-reflectance member at the location right under the light source, and said low-reflectance member consists of a layer made of an electrically conductive material.

* * * * *